United States Patent [19]

Schönholzer

[11] Patent Number: 4,788,952

[45] Date of Patent: Dec. 6, 1988

[54] ROTARY PISTON INTERNAL COMBUSTION ENGINE

[76] Inventor: Arthur Schönholzer, Trottenstrasse 62, Zürich, Switzerland

[21] Appl. No.: 939,120

[22] PCT Filed: Mar. 6, 1986

[86] PCT No.: PCT/CH86/00029

§ 371 Date: Nov. 14, 1986

§ 102(e) Date: Nov. 14, 1986

[87] PCT Pub. No.: WO86/05545

PCT Pub. Date: Sep. 25, 1986

[30] Foreign Application Priority Data

Mar. 18, 1985 [CH] Switzerland ..... 1195/85

[51] Int. Cl.[4] ..... F02B 53/00

[52] U.S. Cl. ..... 123/245; 418/36

[58] Field of Search ..... 123/245; 418/33, 35, 418/36, 37, 38

[56] References Cited

U.S. PATENT DOCUMENTS 2,816,527 12/1957 Palazzo ..... 418/33 X 4,068,985 1/1978 Baer ..... 418/36

FOREIGN PATENT DOCUMENTS 581431 8/1958 Italy ..... 418/37

*Primary Examiner*—Michael Koczo

*Attorney, Agent, or Firm*—Helfgott & Karas

[57] ABSTRACT

In an apparatus for driving an output shaft (21) by means of a piston and an intermediate driving gear, the piston consists of two piston parts (1, 2), which together form combustion chambers (43). The two piston parts (1, 2) rotate about an axis (A) so that the width of the combustion chambers (43) is variable.

15 Claims, 4 Drawing Sheets

48
43b
42
40
43a
50

50
42
43a
49
43b
40

48
42
43a
40
49
43b 50
48
1
49
43a
A
40
49
42
43b
50
2
48

40
A
43a
43b
49
42

40
43b
49
43a
42

ROTARY PISTON INTERNAL COMBUSTION ENGINE

The invention relates to an apparatus for driving a rotor having an output shift by means of a piston and intermediate driving gears.

The so-called Otto engines are well known. In these engines, a crankshaft or camshaft is driven via several pistons which move radially with respect to the shaft axis. This engine has proved to be disadvantageous in that, on the one hand, several pistons have to be provided in order to achieve a particular engine performance, each piston possessing its own cylinder, its own inlets and outlets and also its own ignition system. On the other hand, power transmission in a radial direction to a camshaft is always unsatisfactory. The Otto engines are in the form of reciprocating engines or rotary engines and function on the basis of the four-stroke or two-stroke principle. The four-stroke principle comprises intake, compression, ignition and combustion, and exhaust.

A rotary engine whose piston executes a continuous rotary movement is also known. An embodiment of this is the Wankel engine, in which a rotary piston which is mounted eccentrically in a trochoidal housing and has the shape of an equilateral triangle rotates by turning about a midpoint which itself simultaneously executes a rotary movement. The working process is based on the four-stroke principle and takes place in the working chambers which are located between the rotary piston and the housing wall, become larger and smaller, and effect gas exchange, i.e. intake, compress, expand and exhaust, with the aid of inlet and outlet slots in the housing wall which are controlled by the rotary piston. The particular advantages of the rotary engine over the reciprocating engine are the smaller number of components, the omission of masses which move to and fro, the omission of valve drive, smaller size and lower weight. On the other hand, however, they have the disadvantage that the production costs are considerable and sealing is complicated, and they possess an unfavourable combustion chamber with high heat losses and in particular have a large amount of uncombusted hydrocarbons and HC in the exhaust gas.

It is the object of the invention to develop a novel drive unit which functions with a small number of components but nevertheless has a very high efficiency, is light and compact, and manages without a camshaft or crankshaft. In particular, it is also intended to not only reduce the surface friction of the piston but to increase the power strokes severalfold.

This object is achieved by means of a piston that consists of two piston parts which together form combustion chambers. The two piston parts rotate about a common axis, the width of the combustion chambers being variable.

It has proved most effective for this purpose for one piston part to be in the form of a cylindrical section having a cutout segment in which the second piston part, in the form of a segment section, is inserted, the angle of the cutout segment being larger than the angle of the segment section. These differences in angles determine the width of the combustion chambers, whereby it is of course also possible to alter the power of the motor. Rotation of the two piston parts through 360° is likewise intended to result in a four-stroke cycle being carried out, namely intake, compression, ignition and exhaust. Preferably, this four-stroke cycle is envisaged at least twice per 360° rotation, but an increase is possible and is likewise within the scope of the invention.

Preferably, the piston parts should be shaped such that they possess in succession at least one cylindrical section and one segment section. This arrangement may of course be reproduced several times. Each cylindrical section or segment section is then assigned to a cylindrical section or segment section of the other piston part. This results in a piston having a prism-like appearance.

For power transmission, each piston part should be connected to a planet gear which in turn forms a frictional connection with a sun wheel, which is coupled to the rotor. This constitutes a further critical aspect of the invention, since it is in this way that the conventional camshaft is dispensed with. The planet gear is itself one stage of the gear. This makes it possible to construct the entire drive unit in a very compact manner.

The structural parts are very simple, the majority of them being cylindrical. The engine runs like a turbine and produces little vibration, the piston speed is relatively low, and there are no sealing problems. Overall, the engine is expected to have a long life and to be cost-effective.

Because of the minimal frictional surfaces and the power-to-weight ratio, the engine will also be useful in the area of high-speed engines, such as, for example, racing engines and aircraft engines. Diesel engines based on this design are also possible.

Other advantages, characteristics and details of the invention are evident from the following description of preferred embodiments and from the drawing, wherein like reference characters designate like parts and wherein FIG. 1 shows a longitudinal cross-section through a drive according to the present invention;

Figure 1:
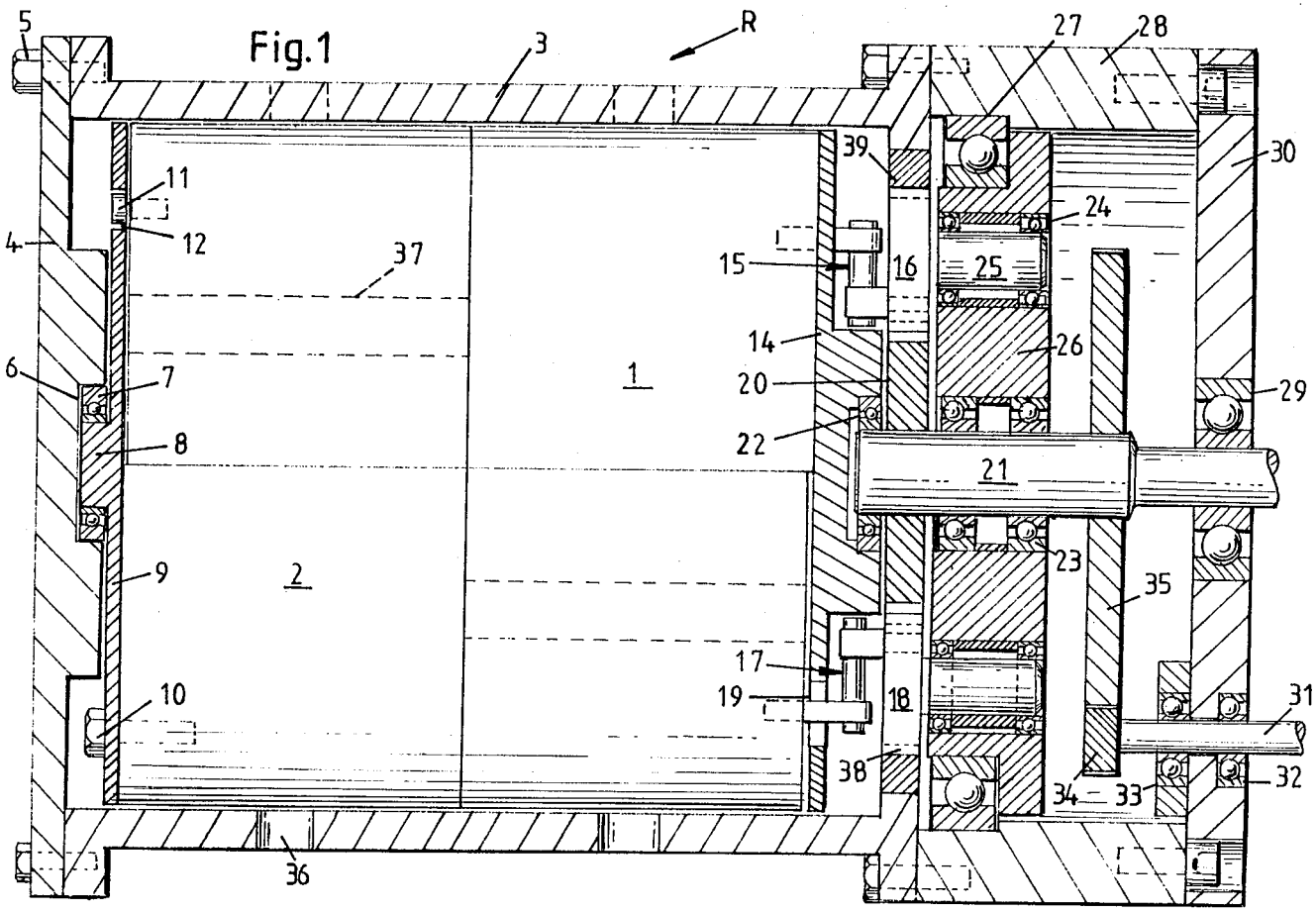

In FIG. 1, piston parts 1 and 2 of a drive unit R are surrounded by a cylindrical housing part 3, this being shown only schematically here but in more detail in FIGS. 2 to 6. This housing part 3 is closed at one end with an endplate 4 by means of fastening elements 5, the said endplate possessing a round hole 6 in the middle for holding a bearing 7. An axial journal 8 of a disc 9 which is connected to the piston part 2 by means of screws 10 rotates in this bearing 7. A stop pin 11 passes through an elongated hole 12 in order to permit axial movement of piston part 1 relative to piston part 2. Both piston parts 1 and 2 are movable relative one to the other. The piston part 1 is firmly connected to a rotary disc 14 which does not come into contact with the piston part 2 and the disc 9 is connected to the piston part 2 and does not come into contact with the other piston part 1.

Opposite the disc 9, the piston part 1 is firmly connected to a rotary disc 14, which does not come into contact with the piston part 2. The rotary disc 14 is connected to the piston part 1 via an elbow lever element 15, the other end of which is fixed eccentrically on a gear wheel 16. The piston part 2, too, is connected eccentrically to a gear wheel 18 via an elbow lever element 17, a recess 19 in the rotary disc 14 permitting freedom of movement of the elbow lever element 17. Both gear wheels 16 and 18 engage an inner toothing 38 of a ring 39 connected firmly to the housing part 3 and at the same time move around a sun wheel 20 which is connected to an output shaft 21, so that finally this output shaft 21 forms a frictional connection with the planetary gear formed from the two gear wheels 16 and 18. This frictional connection of the inner toothing 38 to the gear wheels 16 and 18 and the sun wheel 20 inevitably produces the controlled rotation of the piston units 1 and 2 and correspondingly controls the four strokes, intake, compression, ignition and exhaust, during a revolution of 360°. Accordingly, the relationship of these parts with one another is also very important from the point of view of design.

The output shaft 21 rotates in a bearing 22 in the rotary disc 14. Further bearings 23 and 24 for the rotor 21 and gear axles 25 respectively are provided in a rotary disc 26 which is arranged in a principal bearing 27, which supports the rotary disc 26 on a further housing shell 28. This housing shell 28 is on the one hand screwed to the housing part 3 and on the other hand covered by an endplate 30, which contains a further pivot bearing 29 for the output shaft 21. Furthermore, the endplate 30 is penetrated by a shaft 31 in further bearings 32 and 33, the said crank engaging a drive disc 35 by means of a gear 34.

Additionally, four threaded holes 36 for the insertion of spark plugs, and two inlet and outlet slots 37, indicated by broken lines, are provided in the housing part 3.

Figure 3:
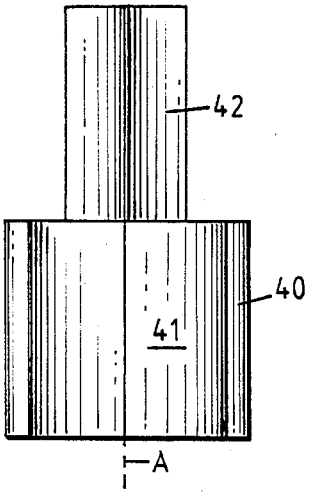
FIG. 3 shows a plan view of the piston part shown in FIG. 2.
Figure 2:
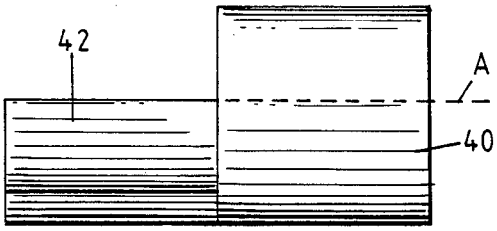
FIG. 2 shows a schematic sideview of a piston part according to the present invention.
Figure 4:
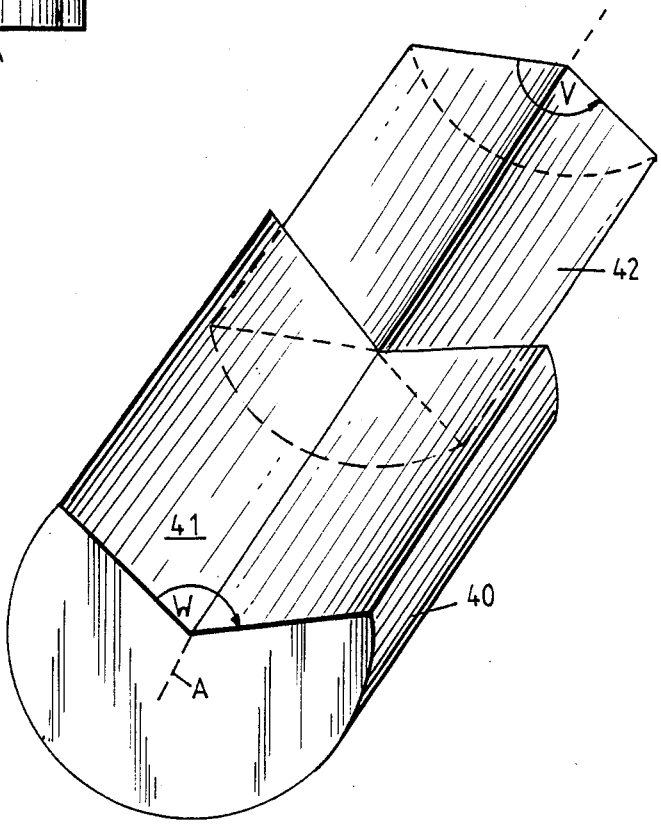
FIG. 4 shows a perspective view of the piston part shown in FIG. 2.
Figure 5:
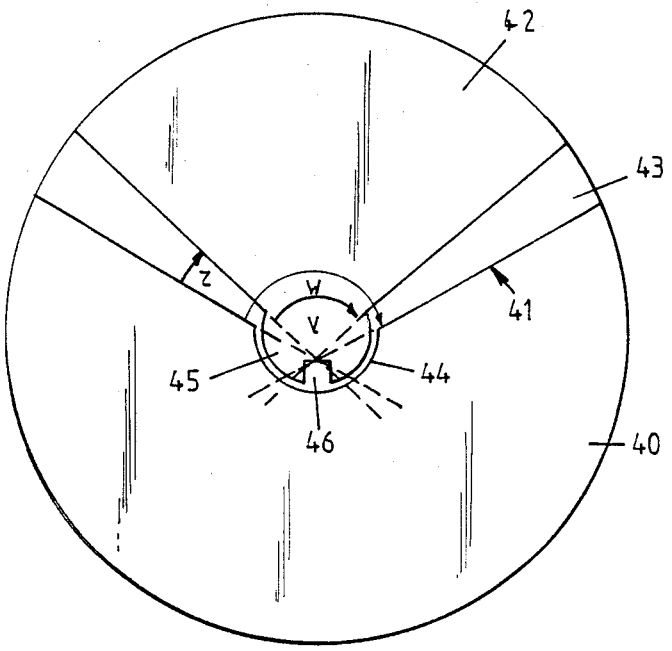
FIG. 5 shows a schematic elevational view through an assembled piston consisting of two piston parts.

As shown in FIGS. 2 to 4, each piston part 1 or 2 consists of a cylindrical section 40 with a cutout segment 41 and an added or formed segment section 42. An angle w of the cutout segment 41 is larger than an angle v of the segment section 42 around the common piston axis A. The ratio of the angle w to v is one of the factors which determines the power of the drive, since a complete piston consists of two piston parts 1 and 2 in a mirror-image arrangement, four combustion chambers 43 thus being formed, only two of which are indicated in FIG. 5. The greater the difference between the two angles w and v, the larger is the combustion chamber 43 or the angular aperture z.

Additionally, FIG. 5 shows a feature a piston in which, at the bottom of the cutout segment 41 in the cylindrical section 40, a channel 44 is formed in which the segment section 42 rests by means of a bead strip 45. A crown groove 46 is formed in the bead strip 45, the said groove holding a sealing strip which is not illustrated and the functions of which resemble those of a conventional piston ring.

FIG. 6 shows the mode of operation of the piston of a four-chamber rotor, only the interaction between a cylindrical section 40 and a segment section 42 being illustrated. When the entire piston is considered, each of the elements described below is present in duplicate. During a rotation through 360°, two working strokes (compression and explosion strokes) are envisaged for each combustion chamber, the ignition system being indicated by 48. However, the invention also envisages arranging the spark plugs on an internal surface in the cutout segment 41, i.e. in the combustion chamber 43, with the result that combustion is improved, although at the cost of easy access to the spark plugs.

Furthermore, outlets 49 and inlets 50 are provided, in each case opposite one another.

Figures 6A, 6B, 6C, 6D, 6E, 6F:
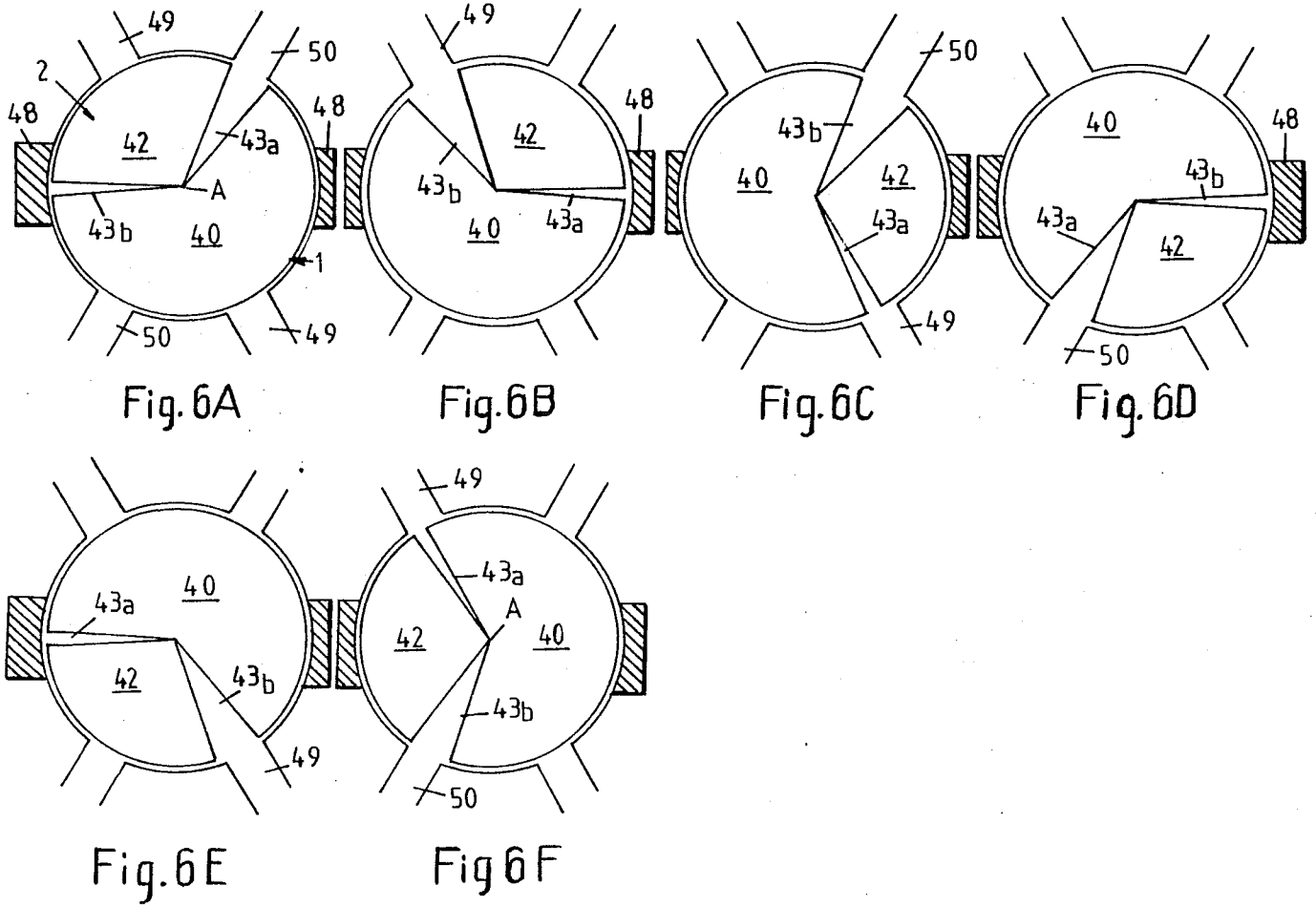
FIGS. 6A, 6B, 6C, 6D, 6E and 6F illustrate successive steps in the operation of the drive according to the invention.

The position in FIG. 6*a* shows that fuel is being taken into one combustion chamber 43*a*, while ignition is just taking place in the other chamber 43*b*. Consequently, the chamber 43*b* is opened, whereas the volume of the 1 chamber 43*a* is reduced while the rotary movement of the piston about the axis A is accelerated. The two chambers come into position shown in FIG. 6B. The combustion gases can pass from the chamber 43*b* into the outlet 49, while at the same time ignition takes place in the chamber 43*a*. The gases from this ignition are once again removed from the chamber 43*a* through the subsequent outlet, new fuel being sucked into the chamber 43*b*, as shown in position FIG. 6C. In position shown in FIG. 6D., the chamber 43*b* is ignited again, while the chamber 43*a* passes the outlet 50. In position FIG. 6E., ignition takes place in the chamber 43*a* while the chamber 43*b* passes the outlet 49. Finally, the chamber 43*a* is at outlet 49 when the chamber 43*b* is once again in the intake cycle shown in FIG. 6F. The next position is once again as shown in FIG. 6A. A rotation through 360° is thus complete, the appropriate changes required for chambers 43*a* and 43*b* being effected in particular by the ignition and by the movement of the gear wheels 16 and 18.

Altogether, 32 strokes per revolution are performed, eight of which are working strokes. This constitutes six working strokes more than in the case of a conventional Otto or Wankel engine, and the surface friction is substantially lower since a corresponding Otto or Wankel engine would have to possess a piston area about 40 to 50% larger. The piston speed is substantially lower than in the case of the engines known to date, in particular about 20 to 30% lower. The piston speed required is no more than 8 to 10 m/sec.

Intake and exhaust result inevitably from the rotation of the rotor, with high suction and scavenging efficiency. At these points, there are no moving parts, such as valves, which would require maintenance.

The entire drive unit can be cooled, in appropriate cavities, with water or oil.

What is claimed:

1. A rotary piston engine wherein two rotating pistons rotate around one axis within a cylindrical case, the pistons being connected with a motor shaft by means of a crank gear and a planetary gear system, the pistons forming together four variable combustion chambers, each piston being provided with at least one segmented cylinder cutout (41) and at least one axially spaced segmented cylinder section (42), the segmented cylinder cutout (41) having a greater angle than the segmented cylinder section (42), so that the segmented cylinder section (42) of one piston is arranged within the segmented cylinder cutout (41) of the other piston.

2. Apparatus according to claim 1, characterised in that both piston parts (1, 2) rotate about an axis (A) and the volume (Z) of the combustion chambers (43) is variable.

3. Apparatus according to claim 1, characterised in that a channel (44) is formed in the bottom of the cutout segment (41), and the segment section (42) includes a bead strip (45) that rests in the said channel.

4. Apparatus according to claim 2, characterised in that the piston parts (1,2) rotate in a housing part (3)

which has at least one outlet (49) for combustion gas and at least one inlet (50) for the fuel.

5. Apparatus according to claim 4, characterised in that an ignition device is assigned to the combustion chamber (43).

6. Apparatus according to claim 4, characterised in that at least one ignition system (48) is arranged in the housing part (3).

7. Apparatus according to claim 6, characterised in that there are plurality of ignition systems (48) and further characterized in that there are two outlets (49) and two inlets (50) are opposite every two ignition systems (48).

8. Apparatus according to one of claim 7, characterised in that the angles (w, v) and the arrangement of the ignition system (48), the outlets (49) and the inlets (50) are chosen so that one combustion chamber (43*b*) is ignited when the other is connected to the inlet (50), in the subsequent position the chamber (43*b*) is connected to the outlet (49) while the other chamber (43*a*) is ignited, and in the further position one chamber (43*b*) is then at inlet (50) and the other (43*a*) is at the outlet.

9. Apparatus according to claim 8, characterised by means that assure that the stated positions are achievable at least twice during a rotation of the piston through 360°.

10. Apparatus according to claim 1, characterised in that each cylindrical section (40) is connected to at least one segment section (42), to each of which accordingly is assigned a piston part having at least one segment section (42) and a cylindrical section (40).

11. Apparatus according to one of claim 1, characterised in that each piston part (1, 2) is connected to a planet gear (16, 18), which in turn forms a frictional connection with an inner toothing (38) of a housing ring (39) and a sun wheel (20) which is coupled to the output shaft (21).

12. Apparatus according to claim 11, characterised in that the piston parts (1, 2) are connected to the planet wheel (16, 18) via elbow lever elements (15, 17).

13. Apparatus according to claim 11, characterised in that the gears rest with gear axles (25) in bearings (24) which are parts of a rotating disc (26) which rotates in a main bearing (27) between a housing shell (28) and the said disc and is penetrated by the output shaft (21) in a further bearing (23).

14. Apparatus according to one of claim 11, characterised in that, at least for starting, the output shaft (21) can be rotated by means of a shaft (31) and a gear (34) which interlocks with a drive disc (35).

15. Apparatus according to one of claim 1, characterised in that the end face of each of the piston parts (1, 2) is covered by discs (9, 14) which are connected firmly to one piston part and are not in contact with the other, but include means (12), (19) allowing the two piston parts (1, 2) to move relative to one another.

* * * * *